US005618358A

United States Patent [19]

Davisson et al.

[11] Patent Number: 5,618,358

[45] Date of Patent: Apr. 8, 1997

[54] ALUMINUM ALLOY COMPOSITION AND METHODS OF MANUFACTURE

[76] Inventors: Thomas Davisson, 1489 Radcliff La., Aurora, Ill. 60504; Sadashiv Nadkarni, 85 Kendall Rd., Lexington, Mass. 02173; Douglas Reesor, 232 Highland Ct., Terre Haute, Ind. 47802

[21] Appl. No.: 397,604

[22] Filed: Mar. 1, 1995

[51] Int. Cl.[6] ..... C22F 1/04

[52] U.S. Cl. ..... 148/549; 148/551; 148/552; 148/691; 148/692; 148/695; 148/696; 148/416; 148/438; 420/529; 420/537; 420/538; 420/548; 420/550; 420/551; 420/553

[58] Field of Search ..... 148/549, 551, 148/552, 692, 695, 696, 691, 416, 438; 420/529, 537, 538, 548, 550, 551, 553

[56] References Cited

U.S. PATENT DOCUMENTS

| | | | |
|---|---|---|---|
| 3,814,590 | 6/1974 | Bylund | 148/437 |
| 3,938,991 | 2/1976 | Sperry et al. | 420/551 |
| 4,163,665 | 8/1979 | Pearson | 148/551 |
| 4,715,901 | 12/1987 | Granger | 148/438 |
| 4,945,004 | 7/1990 | Sprintschnik et al. | 428/469 |

FOREIGN PATENT DOCUMENTS

| | | |
|---|---|---|
| 87-146694 | 6/1987 | Japan . |
| 88-45352 | 2/1988 | Japan . |
| 89-176048 | 7/1989 | Japan . |
| 89-230755 | 9/1989 | Japan . |
| 1444153 | 8/1973 | United Kingdom . |

OTHER PUBLICATIONS

Development of Continuously Cast High Quality Aluminum, Light Metals Age, Aug. 1994 by: M. Marsh, et al.

The Aluminum Association Designations and Chemical Composition Limits for Wrought Aluminum and Wrought Aluminum Alloys. The Aluminum Association, 900 19th Street N.W. Washington, D.C. 20006; Feb. 1991.

*Primary Examiner*—David A. Simmons
*Assistant Examiner*—Robert R. Koehler

[57] ABSTRACT

A new aluminum based alloy having properties which mimic homogenized DC cast 3003 alloy and a low-cost method for manufacturing it are described. The alloy contains 0.40% to 0.70% Fe, 0.10% to less than 0.30% Mn, more than 0.10% to 0.25% Cu, less than 0.10% Si, optionally up to 0.10% Ti and the balance Al and incidental impurities. The alloy achieves properties similar to homogenized DC cast 3003 when continuously cast followed by cold rolling and if desired annealing at final gauge. Suprisingly no other heat treatments are required.

24 Claims, No Drawings

ALUMINUM ALLOY COMPOSITION AND METHODS OF MANUFACTURE

BACKGROUND OF THE INVENTION

This invention relates to aluminum alloy sheet products and methods for making them. Specifically this invention relates to a new aluminum alloy which can be substituted for conventional homogenized DC cast 3003 alloy in any temper; as rolled, partially annealed or fully annealed and method of making it. An important aspect of the present invention is a new aluminum alloy suitable for use in household foil and semi rigid foil containers having a combination of strength and formability and an economical method for its manufacture using a continuous caster.

Semi rigid foil containers are manufactured from aluminum sheet rolled to a thickness of 0.002–0.010 inches. The sheet is then cut to a desired shape and formed into a self supporting container commonly used for food items such as cakes, pastries, entrees, cooked vegetables, etc. Conventional DC cast 3003 alloy is commonly used for this application. Generally the term sheet will be used herein to refer to as cast or rolled alloy having a thickness that is relatively thin compared to its width and includes the products commonly referred to as sheet, plate and foil.

The conventional method for manufacturing 3003 alloy is to direct chill (DC) cast an ingot, homogenize the ingot by heating to a temperature sufficient to cause most of the manganese to go into solid solution, cool and hold at a temperature where a significant portion of the manganese precipitates out of solution, hot roll the ingot to a predetermined intermediate gauge, cold roll to final gauge optionally with interannealing between at least some of the cold rolling passes and then annealing the cold rolled alloy sheet to the desired temper. Typical mechanical properties of 3003 alloy produced in this manner is shown in Table 1:

TABLE 1

Typical Mechanical Properties of 3003 Alloy

| Temper | UTS (Ksi) | YS (Ksi) | Elong. % | Olsen |
|---|---|---|---|---|
| As Rolled | 34.8 | 30.8 | 2 | — |
| H26 | 24.6 | 23.3 | 11 | 0.208 |
| H25 | 23.1 | 20.5 | 15 | 0.248 |
| H23 | 22.2 | 18.5 | 18 | 0.251 |
| O | 15.1 | 7.0 | 20 | 0.268 |

Furthermore, DC cast 3003 alloy is relatively insensitive to variations in the final annealing process allowing for reproducible properties that are consistent from coil to coil. For example, variations in the properties of DC cast 3003 annealed at various temperatures are shown in Table 2;

TABLE 2

Properties of DC Cast 3003

| Annealing Temp °C. | UTS (Ksi) | YS (Ksi) | Elongation % |
|---|---|---|---|
| As rolled | 42.2 | 37.5 | 2.0 |
| 250 | 27.2 | 24.5 | 2.2 |
| 260 | 24.7 | 21.5 | 10.4 |
| 270 | 23.8 | 20.2 | 13.8 |
| 280 | 22.6 | 17.8 | 16.4 |
| 290 | 21.6 | 14.0 | — |
| 350 | 16.4 | 7.5 | 22.4 |

Because of these useful properties DC cast 3003 has found numerous uses and DC cast 3003 is a commonly used alloy. A typical composition for 3003 including maximum and minimum limits is :

Cu: 0.14 (0.05–0.20) %

Fe: 0.61 ((0.7 max.) %

Mn: 1.08 (1.0–1.5) %

Si: 0.22 (0.6 max.) % Zn: 0.00 (0.10 max.) % Ti: 0.00 (0.10 max,) %

Balance Al and incidental impurities.

This alloy belongs to the category of dispersion hardened alloys. With aluminum alloys dispersion hardening may be achieved by the addition of alloying elements that combine chemically with the aluminum or each other to form fine particles that precipitate from the matrix. These fine particles are uniformly distributed through the crystal lattice in such a way to impede the movement of dislocations causing the hardening effect. Manganese is such an alloying element. Manganese is soluble in liquid aluminum but has a very low solubility in solid aluminum. Therefore as 3003 cools down after casting dispersoids form at the expense of Mn in solution. The dispersoids are fine particles of $MnAl_6$ and alpha manganese ($Al_{12}Mn_3Si_2$). The formation of these dispersoids is a slow process and in practice more than 60% of the Mn remains in solution after DC cast 3003 ingots have solidified. During homogenization the dispersoids tend to go into solid solution until equilibrium is reached. The ingot is then cooled to a lower temperature and maintained for a prolonged period of time to form dispersoids from about 80% of the available Mn.

Continuous casting, on the other hand, can produce substantially different properties from dispersion hardening alloys because cooling rates are generally much faster than with DC casting. Continuous casting can also be more productive than DC casting because it permits the casting of a shape that is closer to common sheet dimensions which then requires less rolling to obtain the final gauge. Several continuous casting processes and machines have been developed or are in commercial use today for casting aluminum alloys specifically for rolling into sheet. These include the twin belt caster, twin roll caster, block caster, single roll caster and others. These casters are generally capable of casting a continuous sheet of aluminum alloy less than 2 inches thick and as wide as the design width of the caster. Optionally, the continuously cast alloy can be rolled to a thinner gauge immediately after casting in a continuous hot rolling process. The sheet may then coiled for easy storage and transportation. Subsequently the sheet may be hot or cold rolled to the final gauge, optionally with one or more interannealing or other heat treatment steps.

SUMMARY OF THE INVENTION

The present invention relates to a new aluminum alloy and a simple method for its manufacture. The alloy broadly contains more than 0.10% and up to 0.25% by weight copper, at least 0.10% and less than 0.30% by weight manganese, at least 0.40% and up to 0.70% iron, less than 0.10% by weight silicon and optionally up to 0.10% titanium (as a grain refiner) with the balance aluminum and incidental impurities.

This alloy can be continuously cast into an alloy with properties very similar to homogenized DC cast 3003 alloy by continuously casting (optionally with continuous hot rolling immediately after casting), cooling the cast sheet, cold rolling to final gauge and finally, if desired, partially or fully annealing. This process does not require any intermediate heat treatments such as homogenization, solution heat treatments or interannealing. Accordingly, the present process is simpler and more productive compared to most conventional aluminum sheet production processes which generally do involve at least some form of intermediate heat treatments, such as the DC casting route conventionally used to produce 3003 alloy.

When 3003 alloy was cast on a continuous caster without homogenization, most of the Mn remained in solid solution. The presence of higher amounts of Mn in solid solution and lower amounts of dispersoids has the effect of making the alloy stronger and lower in formability. The higher amount of Mn in solid solution is believed to retard the process of recrystallization while at the same time increasing the strength of the alloy by solid-solution hardening. The dispersoids act as pins during rolling preventing the grains from growing too large due to recrystallization. Smaller grain sizes are generally associated with better formability.

It has now been found that an alloy having properties similar to DC cast, homogenized 3003 can be produced by continuous casting the present alloy and processing it to final gauge without a need for any intermediate heat treatments. The properties achieved are sufficiently similar to DC cast homogenized 3003 that the present alloy can be directly substituted in current commercial applications for 3003 without changing the processing parameters or having any noticeable effect on the product produced, The present alloy contains copper in an amount in excess of 0.10% and up to 0.25% by weight and preferably between 0.15% and 0.25%. Copper contributes to the strength of the alloy and must be present in an amount adequate to provide the necessary strengthening. Also, within these limits, we have observed some beneficial effect on elongation at a given annealing temperature that is attributable to copper. Excessive copper will make the present alloy undesirable for mixing with used beverage can scrap to be recycled into 3004-type alloy. This would decrease the value of the present alloy for recycling.

The present alloy contains at least about 0.10% manganese but less than 0.30%. Preferably the manganese level is between about 0.10% and 0.20% by weight. The manganese level is optimally the minimum level that is just adequate to provide the necessary solid solution hardening, and no more. If the manganese level is increased above the described levels, part of the manganese will form dispersoids during processing and can result in properties that change rapidly and less predictable during annealing making it harder to reproduce properties from coil to coil.

The iron level in the present alloy should be maintained between about 0.40% and about 0.70% and is preferably maintained above 0.50% and most preferably above 0.60% by weight. The iron initially reacts with the aluminum to form $FeAl_3$ particles which act as pins retarding grain growth during processing. These particles effectively substitute for the $MnAl_6$ particles present in homogenized DC cast 3003 alloy. Generally, higher levels of iron are better in the present alloy, however, this must be balanced with the impact that iron levels can have on recycling. Like high copper alloys, high iron alloys are not as valuable for recycling because they cannot be recycled into valuable low iron alloys without blending in primary low iron metal to reduce the overall iron level in the recycled metal. In particularly, beverage can sheet is currently one of the most valuable uses for recycled aluminum alloys and it requires a low iron content.

The present alloy contains less than 0.10% by weight silicon and preferably less than 0.07% Si. Silicon is a naturally occurring impurity in unalloyed aluminum and may exceed 0.10% in some unalloyed aluminum. Accordingly, it may be necessary to select high purity primary aluminum for use in the present alloy. Silicon must be maintained at this low level to avoid reactions with the $FeAl_3$ particles. This reaction tends to take place during cooling or any annealing process and can result in slower recrystallation and consequently larger grain sizes and lower elongation. $FeAl_3$ particles are desirable in the present alloy because they act as pins impeding grain growth.

Titanium may optionally be present in an amount of up to 0.10% as a grain refiner.

The balance of the alloy is aluminum with incidental impurities. It should be noted that even though iron and silicon are normal incidental impurities in unalloyed aluminum they generally do not occur in the ratio required for the present alloy. If silicon is low enough the iron will tend to be too low and if iron is within the desired range the silicon will generally be too high. Accordingly, in preparing the present alloy it is generally necessary to select an unalloyed aluminum with relatively low levels of impurities and add additional iron before casting to provide the desired iron level in the alloy.

After the alloy is melted and the composition adjusted within the above described limits, the present alloy is cast on a continuous casting machine adapted for making sheet products. This form of casting produces an endless sheet of relatively wide, relatively thin alloy. The sheet is desirably at least 24" wide and may be as wide 80" or more. In practice the width of the casting machine generally determines the width of the cast sheet. The sheet is also generally less than 2" thick and is preferable less than 1" thick. It is advantageous that the sheet be thin enough to be coiled immediately after casting or, if the casting machine is so equipped, after a continuous hot rolling step.

The present alloy is then coiled and cooled to room temperature. After cooling the alloy is cold rolled to final gauge. Cold rolling is conducted in one or more passes. One advantage of the present alloy is that no heat treatments of any kind are required between casting and rolling to final gauge. This saves cost, saves time and requires less capital investment to produce the alloy. Homogenization is not required. Solution heat treatment is not required. Interannealing between passes during cold rolling is not required. Indeed, these heat treatments have been found alter the properties of the final alloy such that it no longer mimics the properties of homogenized DC cast 3003.

The present alloy produced in this fashion achieves an average grain size in the "O" temper less than 70 microns and preferably less than 50 microns, measured at the surface of the alloy.

EXAMPLES

Five alloys were cast on a twin belt continuous casting machine. The alloys contained the elements listed in Table 3 with the balance being aluminum and incidental impurities. The caster used was substantially as described in U.S. Pat. No. 4,008,750. The as cast sheet had a thickness of about 0.625 inches and was immediately continuously hot rolled to a thickness of about 0.06 inches.

TABLE 3

| Composition of Continuously Cast Alloys | | | | |
|---|---|---|---|---|
| Alloy | Cu % | Fe % | Mn % | Si % |
| A | 0.20 | 0.65 | 0.42 | 0.06 |
| B | 0.20 | 0.65 | 0.33 | 0.06 |
| C | 0.15 | 0.65 | 0.20 | 0.06 |
| D | 0.20 | 0.65 | 0.15 | 0.04 |
| E | 0.20 | 0.45 | 0.15 | 0.06 |

The cast sheet was then coiled and allowed to cool to room temperature. After cooling the coiled sheets were conventionally cold rolled to a final gauge of 0.003 inches without interannealing.

Sections of the cold rolled sheets were annealed in the laboratory at various temperatures. Annealing was conducted by heating the samples at a rate of 50° C. per hour and then holding the sample at the annealing temperature for 4 hours. The properties of the as rolled sheet, the various partially annealed sheets and fully annealed ("O" temper) sheet were measured and are presented together with typical properties of DC cast 3003 previously obtained using the same test methods and equipment. O temper was produced by annealing at 350° C.–400° C. for 4 hours. These measured properties are shown in Tables 4–7.

TABLE 4

| | Yield Strength (Ksi) | | | | | |
|---|---|---|---|---|---|---|
| Temp °C. | A | B | C | D | E | 3003 |
| As rolled | 40.7 | 38.1 | 37.2 | 36.7 | 37.1 | 37.5 |
| 245 | 30.1 | 29.6 | 26.6 | 25.7 | 26.9 | — |
| 250 | — | — | — | — | — | 24.5 |
| 260 | 28.9 | 27.7 | 25.8 | 22.9 | 24.4 | 21.5 |
| 270 | — | — | — | — | — | 20.2 |
| 275 | 27.0 | 25.8 | 21.7 | 19.7 | 21.0 | — |
| 280 | — | — | — | — | — | 17.8 |
| 290 | 25.5 | 24.4 | 20.0 | 13.6 | 11.7 | 14.0 |
| 305 | 22.2 | 18.7 | — | 9.3 | 7.6 | — |
| "O" Temper | 8.0 | 7.7 | 7.7 | 6.9 | 6.8 | 7.5 |

TABLE 5

| | Elongation % | | | | | |
|---|---|---|---|---|---|---|
| Temp °C. | A | B | C | D | E | 3003 |
| As Rolled | 1.8 | 2.0 | 2.5 | 3.0 | 3.0 | 2.0 |
| 245 | 2.2 | 2.2 | 4.0 | 5.0 | 3.5 | — |
| 250 | — | — | — | — | — | 2.2 |
| 260 | 2.3 | 2.7 | 5.0 | 9.5 | 6.0 | 10.4 |
| 270 | — | — | — | — | — | 13.8 |
| 275 | 3.3 | 3.2 | 7.5 | 16.5 | 10.5 | — |
| 280 | — | — | — | — | — | 16.4 |
| 290 | 6.4 | 6.3 | 11.5 | 16.5 | 9.5 | 13.8 |
| 305 | 6.2 | 5.8 | — | 22.0 | 18.0 | — |
| "O" Temper | 14.0 | 14.0 | 18.5 | 22.0 | 21.0 | 22.4 |

TABLE 6

| | Olsen Values | | | | | |
|---|---|---|---|---|---|---|
| Temp °C. | A | B | C | D | E | 3003 |
| 245 | 0.157 | 0.146 | 0.206 | 0.188 | 0.145 | 0.208 |
| 260 | 0.176 | 0.179 | 0.197 | 0.194 | 0.159 | 0.248 |
| 275 | 0.180 | 0.181 | 0.216 | 0.216 | 0.185 | — |
| 280 | — | — | — | — | — | 0.251 |
| 290 | 0.184 | 0.193 | 0.215 | 0.200 | 0.158 | — |
| 305 | 0.118 | 0.106 | — | 0.245 | 0.225 | — |
| "O" Temper | low | low | 0.230 | 0.257 | 0.237 | 0.268 |

TABLE 7

| | Grain Size of "O" Temper Alloy | | | | | |
|---|---|---|---|---|---|---|
| | A | B | C | D | E | 3003 |
| Grain Size in Microns | 92–100 | 76–90 | 42–50 | 38 | 38–45 | 38 |

Yield strength and elongation were determined according to ASTM test method E8. Olsen values are a measure of formability and were determined by using a Detroit Testing machine with a ⅞ inch ball without applying any surface treatments, texturants or lubricants. Grain size was measured on the surface of the samples. If a range of values is shown, the range represents grain size measurements at various surface locations.

Samples A and B contain excess manganese and as shown in Table 7 developed large grains relative to the other samples and relative to the 3003 standard. As a result these samples exhibited low Olsen Values and-low elongation indicating poor formability. Sample D is almost identical to DC cast 3003 in every respect. Sample E is similar and very good, however, the variation in Olsen Values with annealing temperature indicates that it may be somewhat harder to control the properties of this composition. Also, the somewhat lower Olsen Values indicate that the formability is not quite as good as sample D or the 3003 standard. This was confirmed during formability trials in which sample D performed as well as DC cast 3003 and sample E performed well with most shapes, but was unacceptable for forming the most demanding shapes. Sample C is also very similar to the DC cast 3003. However, the grain size is a little higher and the Olsen values a little lower, indicate that the formability is a little lower.

In summary, the present invention teaches a new aluminum based alloy composition and low cost method of manufacturing. The present alloy exhibits properties in all tempers similar to homogenized DC cast 3003 alloy and can be a suitable commercial substitute therefor in most applications.

We claim:

1. A continuously cast aluminum based alloy substantially free of manganese precipitates and consisting essentially of by weight at least 0.4% and less than 0.7% iron, at least 0.1% and less than 0.3% manganese, at least 0.1% and less than 0.25% copper, less than 0.1% silicon, up to 0.1% titanium and the balance aluminum and incidental impurities.

2. The alloy of claim 1 having less than 0.07% silicon.

3. The alloy of claim 1 having at least about 0.5% iron.

4. The alloy of claim 1 having at least about 0.15% copper.

5. The alloy of claim 2 having at least about 0.5% iron.

6. The alloy of claim 2 having at least about 0.15% copper.

7. The alloy of claim 5 having at least about 0.15% copper.

8. The alloy of claim 1 having an average grain size of less than about 70 microns when annealed to an O temper.

9. A method of manufacturing a sheet of aluminum based alloy comprising:

continuously casting an aluminum based alloy consisting essentially of by weight at least 0.04% and than 0.7% iron, at least 0.01% and less than 0.3% manganese, at least 0.1% and less than 0.25% copper, less than 0.1% silicon, up to 0.1% titanium and the balance aluminum and incidental impurities, cooling the alloy, cold rolling the alloy to form a sheet of aluminum based alloy having a desired final gauge, said sheet being substantially free of manganese precipitates, and optionally annealing the sheet of aluminum based alloy after said cold rolling is complete.

10. The method of claim 9 wherein the alloy is not homogenized after casting.

11. The method of claim 9 where the sheet of aluminum based alloy is has an average grain size less than about 70 microns when annealed to an O temper.

12. The method of claim 9 wherein said cold rolling is conducted in more than one pass.

13. The method of claim 12 wherein said sheet of aluminum based alloy is not interannealed between said passes.

14. The method of claim 9 wherein said alloy is not subjected to any heat treatments after casting and before cold rolling to final gauge.

15. The method of claim 14 wherein said alloy is has a grain size less than about 70 microns when annealed to an O temper.

16. The alloy of claim 1 having iron aluminide particles sufficient to control gain growth.

17. A sheet comprising the alloy of claim 1, said sheet having a thickness of about 0.002" to 0.010".

18. A food container comprising a sheet of the alloy of claim 1, said sheet having a thickness of about 0.002" to 0.010".

19. The food container of claim 18 comprising a multi-compartment container pressed from one or more sheets of said aluminum based alloy.

20. The method of claim 9 wherein iron aluminide particles are formed in a quantity sufficient to control grain growth.

21. The method of claim 9 wherein said alloy is cold rolled to form a sheet having a thickness of about 0.002" to 0.010".

22. The method of claim 21 further comprising forming said sheet into a food container.

23. The method of claim 22 wherein said sheet is pressed to form a multi-compartment food container.

24. The method of claim 14 in which said alloy is cold rolled without intermediate heat treatment to form a sheet having a thickness of about 0.002" to 0.010".

* * * * *